US006840893B2

(12) United States Patent
Yoon

(10) Patent No.: US 6,840,893 B2
(45) Date of Patent: Jan. 11, 2005

(54) JUMPING DEVICE FOR EXERCISE

(75) Inventor: Tae-Hyuk Yoon, Namyangju-shi (KR)

(73) Assignee: Poweriser Co., Ltd. (KR)

( * ) Notice: Subject to any disclaimer, the term of this patent is extended or adjusted under 35 U.S.C. 154(b) by 344 days.

(21) Appl. No.: 10/135,157

(22) Filed: Apr. 29, 2002

(65) Prior Publication Data

US 2003/0134720 A1 Jul. 17, 2003

(30) Foreign Application Priority Data

Jan. 17, 2002 (KR) ..... 2002-0002882

(51) Int. Cl.[7] ..... A63B 25/08; A63B 25/00
(52) U.S. Cl. ..... 482/77; 482/75
(58) Field of Search ..... 482/75–77, 142, 482/74, 79–80, 146–148; 36/7.8, 27–28

(56) References Cited

U.S. PATENT DOCUMENTS

| | | | | | |
|---|---|---|---|---|---|
| 2,172,000 | A | * | 9/1939 | Wenker | 482/77 |
| 3,444,631 | A | | 5/1969 | MacLeod | 36/7.8 |
| 5,301,441 | A | * | 4/1994 | Kownacki | 36/7.8 |
| 5,916,071 | A | * | 6/1999 | Lee | 482/77 |
| 5,980,351 | A | * | 11/1999 | McCook | 446/26 |
| 6,397,496 | B1 | * | 6/2002 | Seymour | 36/27 |
| 6,557,271 | B1 | * | 5/2003 | Weaver, III | 36/27 |
| 6,719,671 | B1 | * | 4/2004 | Bock | 482/75 |

FOREIGN PATENT DOCUMENTS

| | | |
|---|---|---|
| DE | 36 10570 A1 | 10/1987 |
| DE | 199 15 813 C1 | 7/2000 |
| FR | 2 783 175 | 3/2000 |
| WO | WO 01/05469 A1 | 1/2001 |

* cited by examiner

*Primary Examiner*—Jerome W. Donnelly
*Assistant Examiner*—Fenn C. Mathew
(74) *Attorney, Agent, or Firm*—Rossi & Associates

(57) ABSTRACT

Disclosed is a jumping device for exercise including an arc-shaped plate spring, a vertical member coupled to the plate spring, a footrest coupled to the vertical member while extending horizontally, a hinge lever hingably coupled to the footrest, a hoof lever hingably coupled to the hinge lever and fixedly mounted to the plate spring in an overlapping state, a shoe case serving as a shoe to be worn by a user, the shoe case being integrally coupled to the footrest while including a shoe bottom plate, and a U-shaped strip member serving as a connecting rod for connecting the footrest to the vertical member, the strip member having leg portions each fixedly mounted at a lower end thereof to an intermediate portion of the shoe bottom plate while extending upwardly and inclinedly toward an upper end thereof, and a connecting portion for connecting the leg portions, and a fitting member fixedly mounted to the connecting portion of the strip member at the rear of the strip member, the fitting member being fitted around the vertical member. The strip member has a function as a connecting rod adapted to maintain the shoe case in its horizontal state, thereby eliminating need for a separate connecting rod. In particular, the jumping device can be conveniently used by children without any danger of injury because no connecting rod is used.

6 Claims, 6 Drawing Sheets

JUMPING DEVICE FOR EXERCISE

BACKGROUND OF THE INVENTION

1. Field of the Invention

The present invention relates to a jumping device for exercise, and more particularly to a jumping device for exercise which includes an arc-shaped plate spring, a vertical member coupled at an upper end thereof to an upper end of the plate spring, a footrest coupled to a lower end of the vertical member while extending horizontally, and a shoe case mounted on the footrest while serving as a connecting rod adapted to maintain the shoe case in its horizontal state, thereby eliminating need for a separate connecting rod.

2. Description of the Related Art

Referring to FIG. 1*a*, a conventional jumping device is illustrated. As shown in FIG. 1*a*, the jumping device includes an arc-shaped plate spring 1, a vertical member 14 coupled at an upper end thereof to an upper end of the plate spring 1 by a coupling member 2, and a footrest 15 coupled to a lower end of the vertical member 14 while extending horizontally. A user's foot may be placed on the footrest 15. The jumping device also includes a hinge lever 10 hingably coupled at an upper end thereof to a desired portion of the footrest 15 by a roller 11, and a hoof lever 5 hingably coupled at an upper end thereof to a lower end of the hinge lever 10 by a roller 6 and fixedly mounted to the lower portion of the plate spring 1 in an overlapping state. The hoof lever 5 is provided at its lower end with a hoof 12 adapted to come into contact with the ground 13 during the use of the jumping device. The roller 6 comes into contact with one major surface of the plate spring 1. In order to support the plate spring 1 opposite to the roller 6, a support block 9 is mounted to the upper end of the hoof lever 5. In FIG. 1*a*, the reference numeral 4 denotes a set screw for coupling the lower end of the plate spring 1 to the lower end of the hoof lever 5. The reference numeral 26 denotes a cushion for absorbing impact generated during the use of the jumping device. Also, the reference numeral 16 denotes a connecting rod connected between the vertical member 14 and the footrest 15 and adapted to maintain the footrest 15 in perpendicular to the vertical member 14, that is, horizontally. The connection of the connecting rod 16 to the footrest 15 is achieved by a fixing pin 18. The reference numeral 3 denotes a guard for the heel of the user. The reference numeral 18' denotes a knee holder fixedly mounted to the upper end of the vertical member 14 and adapted to hold the knee of the user. Where the user desires to use the jumping device, he first inserts his foot though the knee holder 18' under the condition in which a shoe is worn on the foot, and lays the foot on the footrest 15, as shown in FIG. 1*a*. When the user presses the footrest 15, that is, applies a load to the footrest 15 via his foot, the plate spring 1 is bent by the load, thereby causing the footrest 15 to move downwardly. The downward movement of the footrest 15 is carried out until the hinge lever 10 comes into contact with the hoof lever 5, as shown in FIG. 1*b*. When the user raises his foot to release the load applied to the footrest 15, the resilience of the plate spring 1 is exerted on the footrest 15. As a result, the user can jump by virtue of the resilience of the plate spring 1. Thus, the jumping function of the jumping device is carried out. Where an excessive load is applied to the footrest 15, the angle defined between the footrest 15 and the vertical member 14 may widen, so that the footrest 15 no longer maintains its horizontal state. In order to prevent such a problem, the angle between the footrest 15 and the vertical member 14 is maintained by the connecting rod 16. However, the provision of the connecting rod 16 makes it difficult or impossible for persons having a large foot size to use the jumping device. Furthermore, a lot of time and skill are required to assemble the connecting rod 16 between the vertical member 14 and the footrest 15 while maintaining the footrest 15 in its horizontal state. In addition, it is difficult for persons having a thick calf to use the jumping device because the knee holder 18 has a ring shape. Due to such a ring shape of the knee holder 18, the time taken to put on the jumping device is increased.

SUMMARY OF THE INVENTION

Therefore, the present invention has been made in view of the above mentioned problems, and an object of the invention is to provide a jumping device for exercise which includes a shoe case for providing a seat for a shoe worn by the user while having a function as a connecting rod adapted to maintain the shoe case in its horizontal state, thereby eliminating need for a separate connecting rod.

Another object of the invention is to provide a jumping device for exercise which includes a knee holder having a forwardly-open structure to allow the user to wear the knee holder irrespective of the size of his calf.

Another object of the invention is to provide a jumping device for exercise which includes foot holding straps configured to be adjustable in mounting position in accordance with the foot size of the user, thereby allowing the user to use the jumping device irrespective of his foot size.

Another object of the invention is to provide a jumping device for exercise which includes a buffering hoof molded around a hoof plate under the condition in which its molded material fills through holes formed at the hoof plate, so that it can be firmly attached to the hoof plate.

Another object of the invention is to provide a jumping device for exercise which includes a plate spring having a triple-layer structure consisting of layers each made of glass fiber-penetrated synthetic resin, the intermediate layer of the triple-layer structure being made of a resin layer having glass fibers arranged in the form of an annual ring shape in order to obtain a maximum elasticity.

In accordance with the present invention, these objects are accomplished by providing a jumping device for exercise comprising an arc-shaped plate spring, a vertical member coupled at an upper end thereof to an upper end of the plate spring, a footrest coupled to a lower end of the vertical member while extending horizontally, a hinge lever hingably coupled at an upper end thereof to a portion of the footrest, and a hoof lever hingably coupled at an upper end thereof to a lower end of the hinge lever and fixedly mounted to a lower portion of the plate spring in an overlapping state, further comprising:

a shoe case serving as a shoe to be worn by a user, the shoe case being integrally coupled to an upper surface of the footrest while including a shoe bottom plate, and a U-shaped strip member serving as a connecting rod for connecting the footrest to the vertical member;

the strip member having a pair of leg portions each fixedly mounted at a lower end thereof to an intermediate portion of the shoe bottom plate while extending upwardly and inclinedly toward an upper end thereof, and a connecting portion for connecting the leg portions; and a fitting member fixedly mounted to the connecting portion of the strip member at the rear of the strip member, the fitting member being fitted around the vertical member.

The jumping device may further comprise a knee holder coupled to the upper end of the vertical member, the knee holder comprising a frame having a forwardly-open structure to horizontally receive the knee of the user and to support the knee at the backside of the knee, knee holding straps mounted to a front portion of the frame and adapted to hold the knee in the frame, and an auxiliary frame mounted to a rear portion of the frame while being coupled to the vertical member by a set screw.

The jumping device may further comprise foot holding straps mounted to the shoe case by set screws, and threaded holes formed at the shoe bottom plate and the strip member and adapted to be selectively coupled with the set screws, thereby adjusting respective coupling positions of the foot holding straps in accordance with the foot size of the user.

The jumping device may further comprise a hoof plate provided at a lower end of the hoof lever, the hoof plate having a plurality of uniformly spaced through holes, and a buffering hoof molded around the hoof plate under a condition in which a molded material thereof fills the through holes, whereby the buffering hoof is firmly attached to the hoof plate.

The plate spring may comprise a first strip-shaped resin layer formed using parallel glass fibers penetrated in a urethane resin, a second strip-shaped resin layer formed on the first resin layer using glass fibers arranged in the form of annual rings and penetrated in a urethane resin, and a third strip-shaped resin layer formed on the second resin layer using parallel glass fibers penetrated in a urethane resin.

The jumping device may further comprise a fitting member fixedly mounted to the connecting portion of the strip member at the rear of the strip member, the fitting member being fitted around the vertical member.

BRIEF DESCRIPTION OF THE DRAWINGS

The above objects, and other features and advantages of the present invention will become more apparent after a reading of the following detailed description when taken in conjunction with the drawings, in which.

DESCRIPTION OF THE PREFERRED EMBODIMENTS

Now, preferred embodiments of the present invention will be described in detail with reference to the annexed drawings.

Figure 1A:
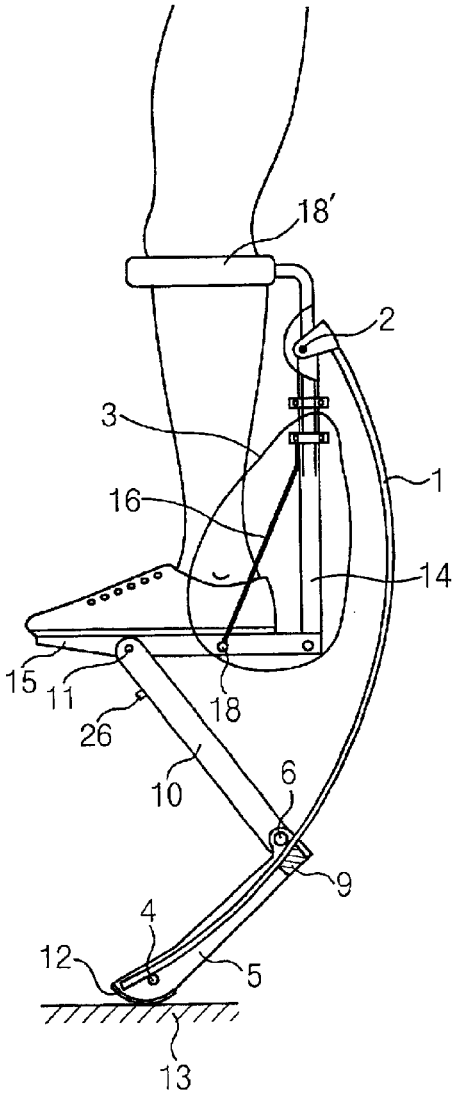
FIG. 1*a* is a side view illustrating a conventional jumping device for exercise.
Figure 1B:
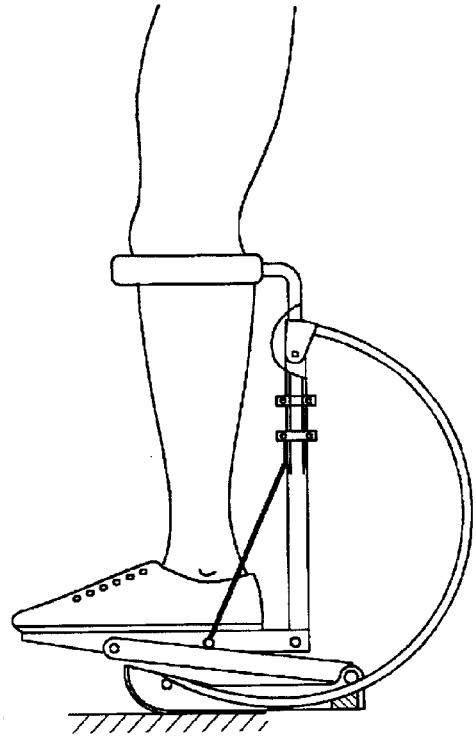
FIG. 1*b* is a side view illustrating a compressed state of the jumping device shown in FIG. 1*a;*
Figure 2:
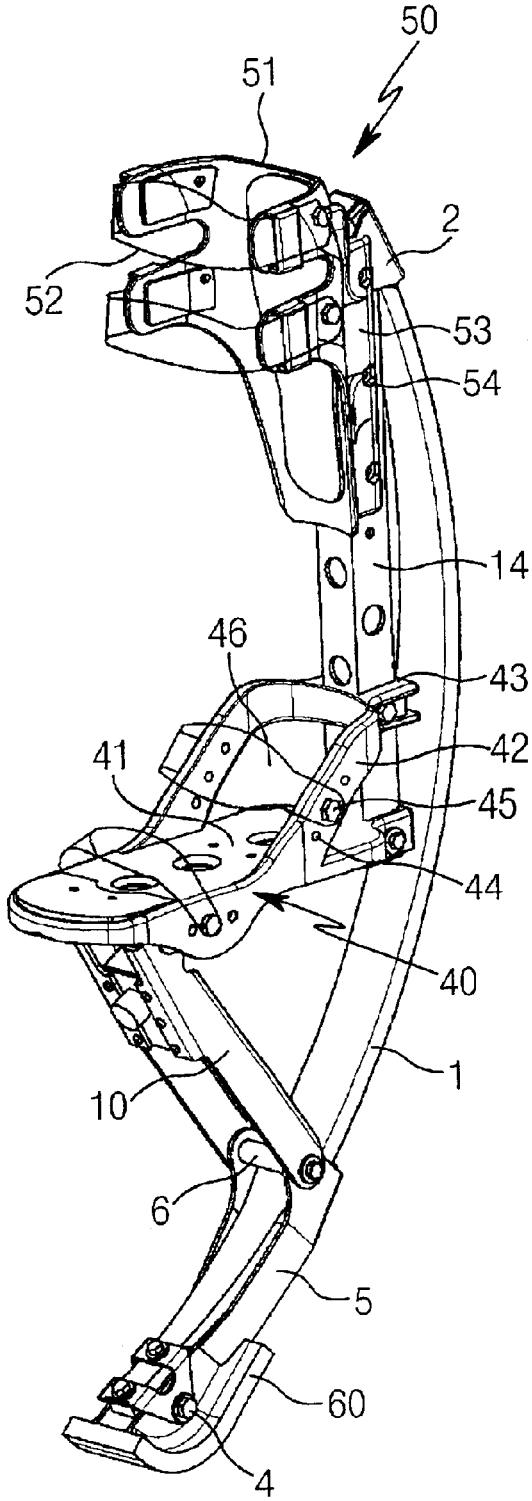
FIG. 2 is a perspective view illustrating a jumping device according to the present invention.
Figure 3:
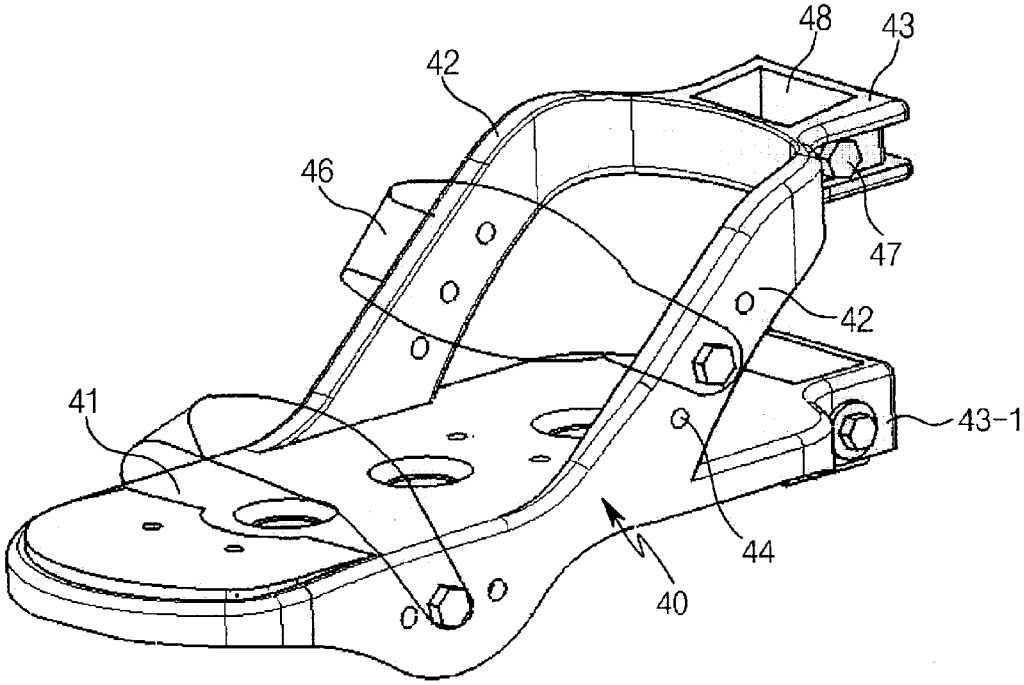
FIG. 3 is an enlarged perspective view illustrating a shoe case included in the jumping device according to the present invention.
Figure 4:
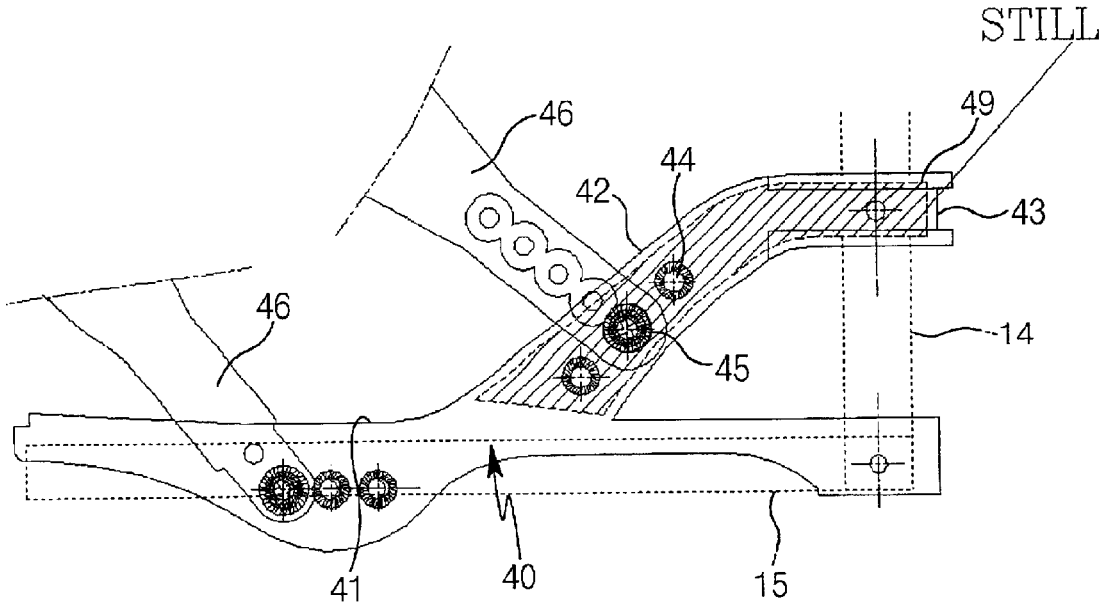
FIG. 4 is a side view illustrating the shoe case coupled to the jumping device according to the present invention.
Figure 5:
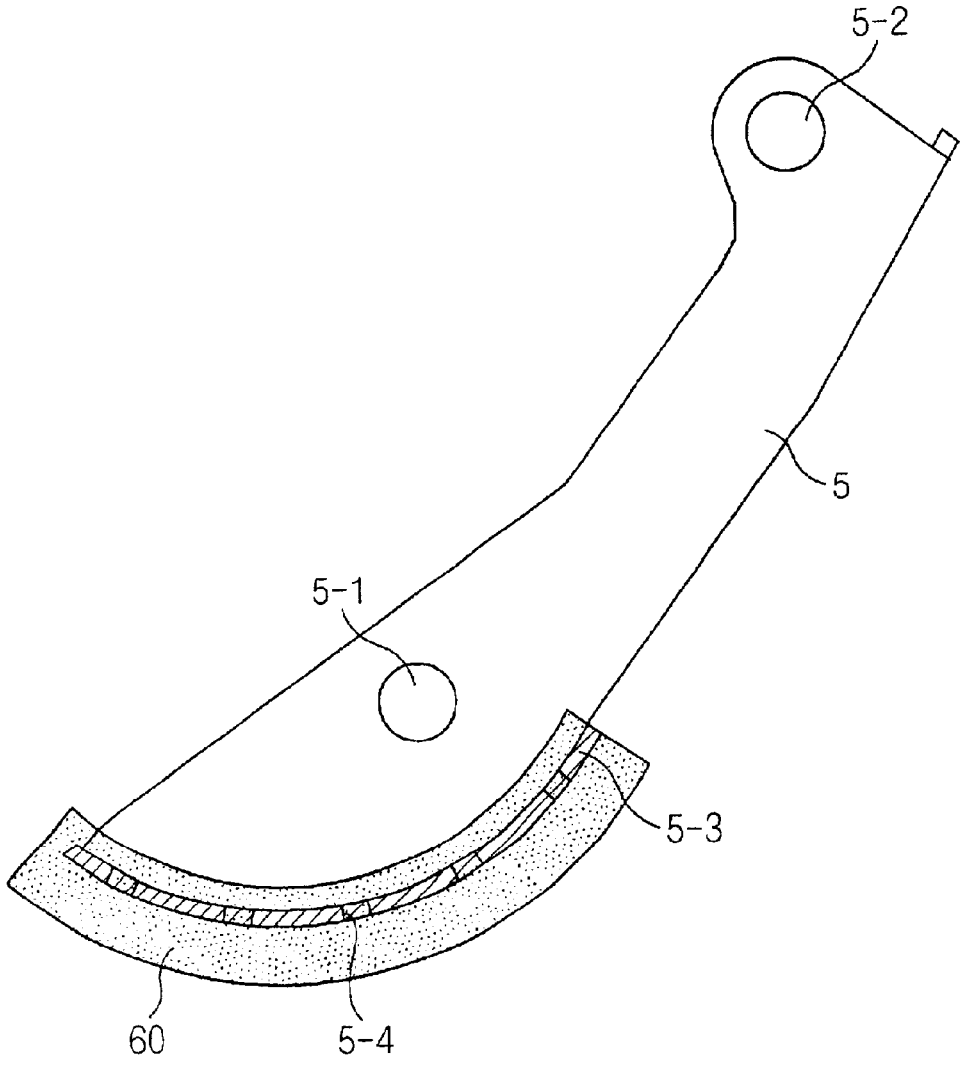
FIG. 5 is a sectional view illustrating a hoof lever included in the jumping device according to the present invention.

FIG. 2 is a perspective view illustrating a jumping device according to the present invention. FIG. 3 is an enlarged perspective view illustrating a shoe case included in the jumping device according to the present invention. FIG. 4 is a side view illustrating the shoe case coupled to the jumping device according to the present invention. FIG. 5 is a sectional view illustrating a hoof lever according to the present invention. In FIGS. 2 to 5, elements respectively corresponding to those in FIGS. 1*a* and 1*b* are denoted by the same reference numerals. As shown in FIG. 2, the jumping device according to the present invention includes an arc-shaped plate spring 1, a vertical member 14 coupled at an upper end thereof to an upper end of the plate spring 1 by a coupling member 2, and a footrest 15 coupled to a lower end of the vertical member 14 while extending horizontally. The jumping device also includes a hinge lever 10 hingably coupled at an upper end thereof to a desired portion of the footrest 15, and a hoof lever 5 hingably coupled at an upper end thereof to a lower end of the hinge lever 10 by a roller 6 and fixedly mounted to the lower portion of the plate spring 1 in an overlapping state.

In accordance with the present invention, the jumping device further includes a shoe case 40 serving as a shoe to be worn by the user. The shoe case 40 is integrally coupled to the upper surface of the footrest 15. The shoe case 40 includes a shoe bottom plate 41, and a U-shaped strip member 42 serving as a connecting rod for connecting the footrest 15 to the vertical member 14. The strip member 42 has a pair of leg portions fixedly mounted at their lower ends to an intermediate portion of the shoe bottom plate 41 while extending upwardly and inclinedly toward their upper ends, and a connecting portion for connecting the upper ends of the leg portions. A fitting member 43 is fixedly mounted to the connecting portion of the strip member 42 at the rear of the strip member 42. The fitting member 43 is fitted around the vertical member 14. A knee holder 50 is coupled to the upper end of the vertical member 14. The knee holder 50 includes a frame 51 having a forwardly-open structure to horizontally receive the knee of the user and to support the knee at the backside of the knee. The knee holder 50 also includes knee holding straps 52 mounted to the front portion of the frame 51 and adapted to hold the knee in the frame 51, and an auxiliary frame 53 mounted to the rear portion of the frame 51 while being coupled to the vertical member 14 by a set screw 54.

Foot holding straps 46 are mounted to the shoe case 40 by set screws 45. Threaded holes 44, which are adapted to be selectively coupled with the set screws 45, are formed at both the shoe bottom plate 41 and the strip member 42 in order to adjust the coupling position of each foot holding strap 46 in accordance with the foot size of the user.

The hoof lever 5 is provided at its lower end with a hoof plate 5-3. A plurality of uniformly spaced through holes 5-4 are formed at the hoof plate 5-3. A buffering hoof 60 is molded around the hoof plate 5-3 under the condition in which its molded material fills the through holes 5-4. In accordance with such a structure, the buffering hoof 60 can be firmly attached to the hoof plate 5-3. The reference numeral 48 denotes an opening defined through the fitting member 43 and adapted to allow the vertical member 14 to extend therethrough. The reference numeral 47 denotes a set screw for coupling the fitting member 43 with the vertical member 14. In FIG. 4, the reference numeral 49 denotes a steel plate for reinforcing the strip member 42. In FIG. 5, the reference numeral 5-2 denotes a roller hole for receiving the roller 6, and the reference numeral 5-1 denotes a threaded hole for receiving a set screw 4 adapted to couple the lower end of the plate spring 1 to the lower end of the hoof lever 5.

As shown in FIG. 3, another fitting member 43-1 may be fixedly mounted to the heel portion of the shoe bottom plate 41 at the rear of the shoe bottom plate 41. The fitting member 43-1 receives the lower end of the vertical member 14.

Figure 6:
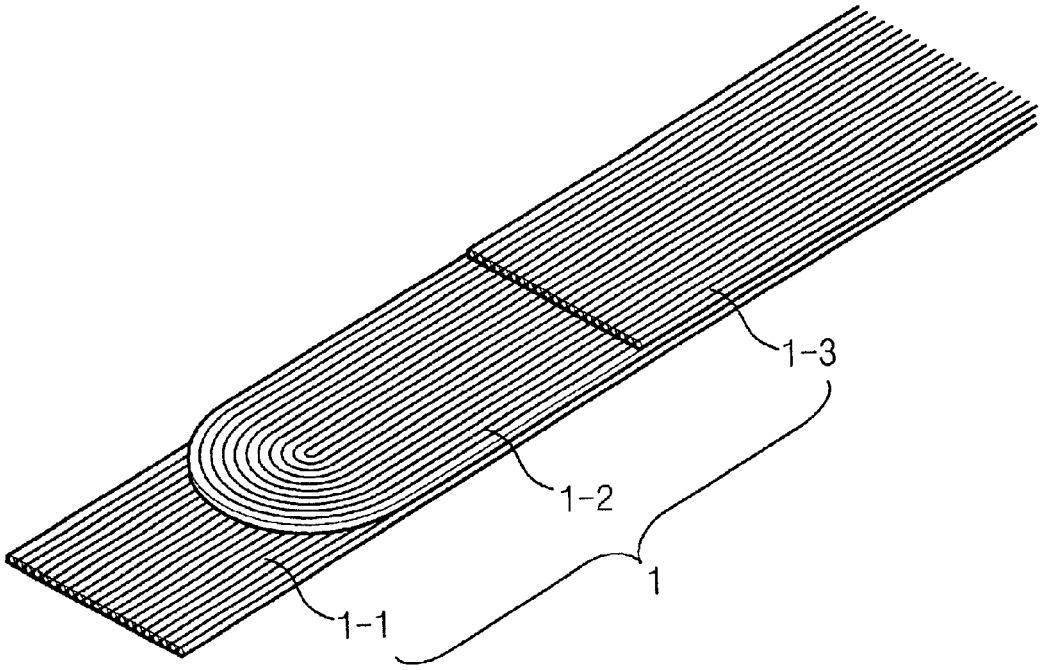
FIG. 6 is a perspective view partially illustrating a plate spring included in the jumping device according to the present invention.

FIG. 6 is a perspective view partially illustrating the plate spring 1 according to the present invention. As shown in FIG. 6, the plate spring 1 includes a first strip-shaped resin layer 1-1 formed using parallel glass fibers penetrated in a urethane resin, a second strip-shaped resin layer 1-2 formed on the first resin layer 1-1 using glass fibers arranged in the form of annual rings and penetrated in a urethane resin, and a third strip-shaped resin layer 1-3 formed on the second resin layer 1-2 using parallel glass fibers penetrated in a urethane resin.

As apparent from the above description, in accordance with the present invention, the shoe case 40 includes the shoe bottom plate 41, and the U-shaped strip member 42 serving as a connecting rod for connecting the footrest 15 to the vertical member 14. The leg portions of the strip member 42 are upwardly inclined as they extend rearwardly. The fitting member 43 is fixedly mounted to the strip member 42 at the rear of the strip member 42 so that it is fitted around the vertical member 14 while being coupled with the vertical member 14 by the set screw 47. In accordance with this configuration, the footrest 15 is firmly coupled with the vertical member 14 while being perpendicular to the vertical member 14, without using any connecting rod. In this regard, it is possible to achieve an easy assembling process for the jumping device. That is, the shoe case 40 including the strip member 42 can be firmly held in a horizontal state only using the set screw 47. In particular, the jumping device can be used irrespective of the foot size of the user because each foot holding strap 46 can be coupled with selected ones of the threaded holes 44 to adjust its mounting position. Of course, the shoe bottom plate 41 must be coupled to the footrest 15 using set screws.

As shown in FIG. 5, the hoof plate 5-3 of the hoof lever 5 has a plurality of uniformly spaced through holes 5-4. Also, the buffering hoof 60 is molded around the hoof plate 5-3 under the condition in which its molded material fills the through holes 5-4 so that it serves as rivets. In accordance with such a structure, the buffering hoof 60 can be firmly attached to the hoof plate 5-3 while exhibiting a superior durability even after a prolonged use time.

Since the knee holder 50 includes the frame 51 having a forwardly-open structure, the user can easily put on the jumping device by horizontally inserting his knee through the opening of the frame 51, and then coupling the knee holding straps 52 to the front portion of the frame 51 to hold the knee in the frame 51. Although not shown, the knee holding straps 52 may be coupled to and separated from the frame 51 using buckles. Accordingly, the jumping device can be used irrespective of the knee size of the user. In particular, the jumping device can be conveniently used by children having diverse knee sizes.

As described above, the plate spring 1 includes the first strip-shaped resin layer 1-1 formed using parallel glass fibers penetrated in a urethane resin, the second strip-shaped resin layer 1-2 formed on the first resin layer 1-1 using glass fibers arranged in the form of annual rings and penetrated in a urethane resin, and the third strip-shaped resin layer 1-3 formed on the second resin layer 1-2 using parallel glass fibers penetrated in a urethane resin. By virtue of such a structure, the plate spring 1 has improved bending characteristics, that is, a superior elasticity and durability, so that it can perform an excellent spring function.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

As apparent from the above description, the present invention provides a jumping device for exercise which includes a shoe case for providing a seat for a shoe worn by the user while having a function as a connecting rod adapted to maintain the shoe case in its horizontal state, thereby eliminating need for a separate connecting rod. In particular, the jumping device can be conveniently used by children without any danger of injury because no connecting rod is used.

Since the jumping device includes a knee holder having a forwardly-open structure, it can allow the user to wear the knee holder irrespective of the size of his calf. Also, it is possible to reduce the time taken for the user to put on the jumping device. In particular, the jumping device can be conveniently used by children having diverse body sizes.

The jumping device includes foot holding straps configured to be adjustable in mounting position in accordance with the foot size of the user. Accordingly, the user can use the jumping device irrespective of his foot size.

The jumping device also includes a buffering hoof molded around a hoof plate under the condition in which its molded material fills through holes formed at the hoof plate, so that it can be firmly attached to the hoof plate.

The jumping device uses a plate spring having a triple-layer structure consisting of layers each made of glass fiber-penetrated synthetic resin. In particular, the intermediate layer of the triple-layer structure is made of a resin layer having glass fibers arranged in the form of an annual ring shape, so as to obtain a maximum elasticity.

What is claimed is:

1. A jumping device for exercise comprising an arc-shaped plate spring, a vertical member coupled at an upper end thereof to an upper end of the plate spring, a footrest coupled to a lower end of the vertical member while extending horizontally, a hinge lever hingably coupled at an upper end thereof to a portion of the footrest, and a hoof lever hingably coupled at an upper end thereof to a lower end of the hinge lever and fixedly mounted to a lower portion of the plate spring in an overlapping state, further comprising:

a shoe case serving as a shoe to be worn by a user, the shoe case being integrally coupled to an upper surface of the footrest while including a shoe bottom plate, and a U-shaped strip member serving as a connecting rod for connecting the footrest to the vertical member;

the strip member having a pair of leg portions each fixedly mounted at a lower end thereof to an intermediate portion of the shoe bottom plate while extending upwardly and inclinedly toward an upper end thereof, and a connecting portion for connecting the leg portions; and a fitting member fixedly mounted to the connecting portion of the strip member at the rear of the strip member, the fitting member being fitted around the vertical member.

2. The jumping device according to claim 1, further comprising:

a knee holder coupled to the upper end of the vertical member, the knee holder comprising a frame having a forwardly-open structure to horizontally receive the knee of the user and to support the knee at the backside of the knee, knee holding straps mounted to a front portion of the frame and adapted to hold the knee in the frame, and an auxiliary frame mounted to a rear portion of the frame while being coupled to the vertical member by a set screw.

3. The jumping device according to claim 1, further comprising:

foot holding straps mounted to the shoe case by set screws; and threaded holes formed at the shoe bottom plate and the strip member and adapted to be selectively coupled with the set screws, thereby adjusting respective coupling positions of the foot holding straps in accordance with the foot size of the user.

4. The jumping device according to claim 1, further comprising:

a hoof plate provided at a lower end of the hoof lever, the hoof plate having a plurality of uniformly spaced through holes; and a buffering hoof molded around the hoof plate under a condition in which a molded material thereof fills the through holes, whereby the buffering hoof is firmly attached to the hoof plate.

5. The jumping device according to claim 1, wherein the plate spring comprises:

a first strip-shaped resin layer formed using parallel glass fibers penetrated in a urethane resin;

a second strip-shaped resin layer formed on the first resin layer using glass fibers arranged in the form of annual rings and penetrated in a urethane resin; and a third strip-shaped resin layer formed on the second resin layer using parallel glass fibers penetrated in a urethane resin.

6. The jumping device according to claim 1, further comprising:

a fitting member fixedly mounted to the connecting portion of the strip member at the rear of the strip member, the fitting member being fitted around the vertical member.

* * * * *